US005778984A

United States Patent [19]

Suwa

[11] Patent Number: 5,778,984

[45] Date of Patent: Jul. 14, 1998

[54] FLUID FIRE EXTINGUISHING AGENT SHELL FOR THROWING

[75] Inventor: Tomisaburo Suwa, Tokyo, Japan

[73] Assignee: Ebisu Science Laboratory Inc., Tokyo, Japan

[21] Appl. No.: 703,464

[22] Filed: Aug. 27, 1996

[30] Foreign Application Priority Data

Mar. 22, 1996 [JP] Japan ..... 8-105996

[51] Int. Cl.[6] ..... A62C 8/00; A62D 1/00; A62D 1/06

[52] U.S. Cl. ..... 169/36; 169/47; 169/58; 252/2; 252/7

[58] Field of Search ..... 252/2, 4, 6, 7, 252/610, 611; 169/47, 36, 58, 81

[56] References Cited

U.S. PATENT DOCUMENTS

| | | | |
|---|---|---|---|
| 3,918,526 | 11/1975 | Hattori et al. | 169/51 |
| 4,224,169 | 9/1980 | Retana | 252/8.05 |
| 4,226,727 | 10/1980 | Tarpley, Jr. et al. | 252/8 |
| 4,285,403 | 8/1981 | Poland | 169/28 |
| 4,756,839 | 7/1988 | Corzon et al. | 252/2 |
| 5,156,890 | 10/1992 | Rock | 427/240 |

FOREIGN PATENT DOCUMENTS

| | | |
|---|---|---|
| 82571 | 3/1992 | Japan . |
| 141184 | 5/1992 | Japan . |
| 58-127668 | 7/1993 | Japan . |
| 313616 | 12/1995 | Japan . |

OTHER PUBLICATIONS

English Abstract of Japanese Patent Application Laid–Open No. 82571, dated Mar. 16, 1992.

English Abstract of Japanese Patent Application Laid–Open No. 141184, dated May 14, 1992.

English Abstract of Japanese Patent Application Laid–Open No. 313616, dated Dec. 5, 1995.

*Primary Examiner*—Joseph D. Anthony

*Attorney, Agent, or Firm*—Beveridge, DeGrandi, Weilacher & Young, LLP

[57] ABSTRACT

A fluid fire extinguishing agent shell for throwing is disclosed, comprising a fluid fire extinguishing agent sealed in a thin-walled resin container having such a size that one can throw, which is breakable by a shock, said fluid fire extinguishing agent being a mixture comprising from about 47% to approximately the saturation point of ammonium chloride , from about 4% to about 8% of sodium bicarbonate, from about 25% to about 35% of potassium carbonate, from about 8% to about 14% of ammonium secondary phosphate, and from about 2% to about 6% of sodium tungstate all in terms of by weight, dissolved in a suitable amount of water, is a simple fire extinguishing appliance that anyone can easily use at the time of occurrence of a fire and which is effective even after the storage for a long period of time.

6 Claims, 1 Drawing Sheet

FLUID FIRE EXTINGUISHING AGENT SHELL FOR THROWING

FIELD OF THE INVENTION

The present invention relates to a fluid fire extinguishing agent shell for throwing, comprising a mixed aqueous solution of a potassium compound, a sodium compound, an ammonium compound, and the like which is molded and packed by a synthetic resin material or the like.

BACKGROUND OF THE INVENTION

There are many instances that conventional installed fire extinguishers are of no use to the initial fire extinction for a reason that in case of emergency a person who uses a fire extinguisher is seized with sudden abnormal fear and loses his or her presence of mind so that he or she can not precisely operate it, or that a fire extinguishing agent in the container changes with a lapse of time such that it does not effectively act, or other reasons. In general, we still have various problems today with respect to the fire prevention and protection means.

In order to solve these problems, the present inventor previously developed a fluid fire extinguishing agent shell for throwing, comprising a solution having a specific gravity of 1.12 sealed in a resin container formed such that it can be readily thrown, said solution being obtained by dissolving a mixture comprising 57% of ammonium chloride, 6% of sodium bicarbonate, 27% of anhydrous sodium carbonate, and 10% of ammonium secondary phosphate in a suitable amount of water and reacting with each other [see Japanese Patent Application Laid-open No. 58-127668]. When such a fluid shell is thrown into the origin of a fire, the decomposition and diffusion of the fluid fire extinguishing agent take place at the same time of the rupture of the container, so that a heat and oxygen get away from the burnt materials to thereby enable to make the flame disappear.

Also, Japanese Patent Application Laid-open No. 4-82571 discloses a hard-capsule fire extinguishing agent comprising powders, liquids, or mixtures thereof contained in a hard capsule made by gelatin. This hard-capsule fire extinguishing agent is emitted into the spot of a fire by means of a high-pressure gas such as a nitrogen gas and a nozzle device, to exhibit the prescribed fire extinction capability.

Also, Japanese Patent Application Laid-open No. 4-141184 discloses a soft-capsule fire extinguishing agent comprising powders, liquids or mixtures thereof contained between gelatin substrate sheets, which is then capsulated. This soft-capsule fire extinguishing agent is also emitted into the spot of a fire by means of a high-pressure gas such as a nitrogen gas and a nozzle device, to exhibit the prescribed fire extinction capability.

Also, Japanese Patent Application Laid-open No. 7-313616 discloses an emergency lifesaving appliance for fires comprising an optional treating substance such as carbonized materials, fermented materials, extracted materials, or fine powders of plants, e.g., woods, bamboos, grasses, algae, seaweeds, etc., an optional metal such as iron, nickel, cobalt, silicon, and aluminum alone, or a complex or composite material thereof, a mixed liquid for fire extinction and smoke-cut having a compound mixed therewith, and air sealed in a container having a good thermal conductivity and heat resistance, provided with fine pores through which the liquid does not release, or with fine exhaust nozzles through which the liquid flows out. This emergency lifesaving appliance for fires is useful for extinguishing the initial fire or preventing the generation of a smoke or poisonous gases, to thereby make a person easy to escape from the spot of a fire. Only by putting this emergency lifesaving appliance in a suitable place, the fire extinction and smoke-cut can be automatically achieved depending on the the generation of a fire. Further, upon carrying the emergency lifesaving appliance, if it is thrown at the time of a fire, the fire extinction can be achieved or generation of soot, smoke and poisonous gased can be prevented, and a person who has failed to escape can be saved from the spot of a fire without being suffocated by the smoke or with the minimum of burns extent.

However, the development of a fluid fire extinguishing agent shell with more superior fire extinction performance has been demanded.

SUMMARY OF THE INVENTION

An object of the present invention is to provide a simple fire extinguishing appliance that anyone can easily use at the time of occurrence of a fire and which is effective even after the storage for a long period of time.

Another object of the present invention is to provide a fluid fire extinguishing agent shell for throwing with an extinction performance superior to the abovedescribed fluid fire extinguishing agent shell developed by the present inventor.

BRIEF DESCRIPTION OF THE ACCOMPANYING DRAWINGS

DETAILED DESCRIPTION OF THE INVENTION

The present inventor further made investigations with respect to a fluid fire extinguishing agent for many years. As a result, it has been found that if potassium carbonate ($K_2CO_3$) is used in place of the anhydrous sodium carbonate, and sodium tungstate ($Na_2WO_4.2H_2O$) is used in the fluid fire extinguishing agent in the above-described fluid fire extinguishing agent shell, not only the fire extinguishing efficiency is markedly improved, but also the fire extinguishing time is shortened owing to the synergistic effect. Also, it has been discovered that in comparison with the previous fluid fire extinguishing agent, if the fire extinguishing agent concentration is increased by from about 11% to about 16%, and the specific gravity is set up at from about 1.20 to about 1.30, the fire extinguishing efficiency is further improved.

That is, the present invention provides a fluid fire extinguishing agent shell for throwing, comprising a fluid fire extinguishing agent sealed in a thin-walled resin container having such a size that one can throw, which is breakable by a shock, said fluid fire extinguishing agent being a mixture comprising from about 47% to approximately the saturation point of ammonium chloride ($NH_4Cl$), from about 4% to about 8% of sodium bicarbonate ($NaHCO_3$), from about 25% to about 35% of potassium carbonate ($K_2CO_3$), from about 8% to about 14% of ammonium secondary phosphate ($(NH_4)_2HPO_4$), and from about 2% to about 6% of sodium tungstate ($Na_2WO_4.2H_2O$) all in terms of by weight, dissolved in a suitable amount of water. In the present invention, the fluid fire extinguishing agent shell comprising a mixture having the composition ratio shown in Example 1 as described below is particularly preferred.

In case that the amount of each of the above-described components in the fluid fire extinguishing agent is too low, the fire extinction capacity is weak, and the number of throwing must be increased. On the other hand, in case that the amounts of the respective components are too high, the precipitation of the fluid fire extinguishing agent occurs, and the fire extinction capacity is markedly lowered.

Usually, it is preferable that the fluid fire extinguishing agent has a specific gravity of from about 1.20 to about 1.30, preferably from about 1.25 to about 1.29, and particularly about 1.29 by dissolving the above-described mixture in water in an amount of from about 2.8 times to about 3.0 times. In case that the specific gravity is lower than about 1.20, since the chemical reaction is weak, if the fire extinction time is too long, the burnt material may be reignited. On the other hand, if the specific gravity exceeds about 1.30, the fire extinguishing agent is hardly disssolved in water such that it is likely to be precipitated as a crystal.

Figure 1:
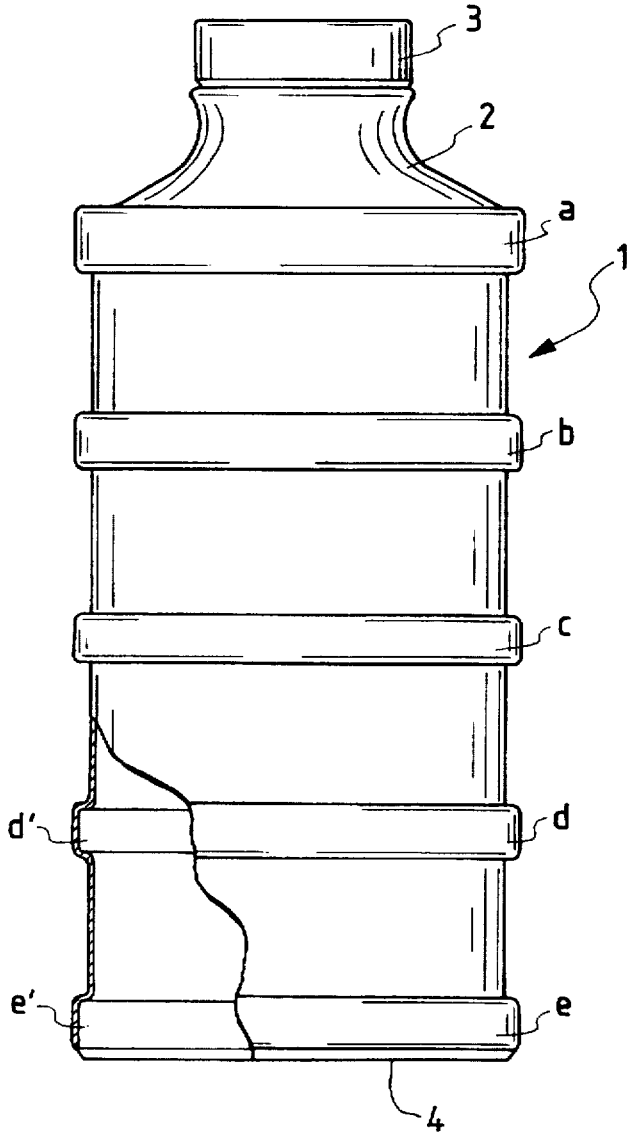
FIG. 1 is a front view of the fluid fire extinguishing agent shell according to the present invention.

The above-described resin container is of a thin-walled rectangular cylinder as shown, for example, in FIG. 1 and conveniently has a volume of from about 500 ml to about 1,200 ml, and particularly from about 800 ml to about 1,000 ml. The material of the container can be, for example, polyvinyl chloride, low-pressure polyethylene, high-pressure polyethylene, polypropylene, or the like.

In case of emergency that a person fighting the clock, grasps the fluid fire extinguishing agent shell of the present invention and throws it into the origin of a fire, the container is ruptured, the diffused fluid fire extinguishing agent causes a chemical reaction by a heat of the burnt material, to thereby take the heat and oxygen away, and the burnt material is cut off from air by emission of a water vapor, to thereby make the flame disappear. The function of each of the components of the fluid fire extinguishing agent is as follows.

(1) Ammonium chloride and potassium carbonate react with each other slighly even at the normal temperature, to thereby emit a weakly ammoniacal odor in the following manner.

$$2NH_4Cl+K_2CO_3 \rightarrow 2NH_3+CO_2+2KCl+H_2O$$

Since the reaction rapidly proceeds as the temperature increases, when the fire extinguishing agent is thrown into a fire, it vigorously reacts to emit $NH_3$ which reacts with oxygen and to be decomposed in the following manner.

$$4NH_3+3H_2O \rightarrow 2N_2+6H_2O$$

Accordingly, the air (oxygen) is rapidly eliminated by these gases ($CO_2$, $N_2$, $NH_3$, $H_2O$), whereby the burning is suppressed.

(2) Ammonium secondary phosphate has been known as a fire extinguishing agent and has hitherto been used in a fire extinguisher. This substance contributes greatly to the fire extinguishing action by the synergistic effect with ammonium chloride and potassium carbonate.

(3) Sodium bicarbonate retards the reaction of (1) at the normal temperature and plays a role in the stabilization action. However, this substance is decomposed at high temperatures to emit $CO_2$ and performs a part of the fire extinguishing action.

(4) Sodium tungstate markedly promotes the synergistic effect of ammonium chloride with potassium carbonate, to thereby contribute greatly to the fire extingishing action.

(5) Since the fire extinguishing agent which has been thrown into a fire and diffused is not spread as a gas, and the remaining chloride and phosphate and the like cover materials and prevent the spread of a fire, there is an effect for preventing reignition. Needless to say, the water itself has a fire extinguishing action based on a large amount of heat of evaporation (endothermic) and elimination of air by an emitted water vapor.

EXAMPLE 1

[A] Preparation of Fluid Fire Extinguishing Agent

A stirrer-equipped dissolver having a volume of 1,000 liters is charged with 650 to 700 liters of water, and (1) 163.0 kg (49.2 wt %) of $NH_4Cl$, (2) 103.0 kg (31.1 wt %) of $K_2CO_3$, (3) 31.0 kg (9.4 wt %) of $(NH_4)_2HPO_4$, and (4) 25.0 kg (7.6 wt %) of $NaHCO_3$ are gradually added into the dissolver in this order while keeping the temperature at the normal temperature (30° C. to 40° C.) and actuating the stirrer, followed by dissolving the mixture in water. Then, (5) 9.0 kg (2.7 wt %) of $Na_2WO_4.2H_2O$ is added, followed by dissolution of the mixture. After completion of the dissolution for 90 to 150 minutes, 250 to 350 liters of water is added thereinto for dilution. It takes about 40 to 60 minutes. The solution is colorless and transparent and has a specific gravity of 1.290 and a pH of 7.5 to 10.0.

[B] Production of Fluid Fire Extinguishing Agent Shell

Figure 2:
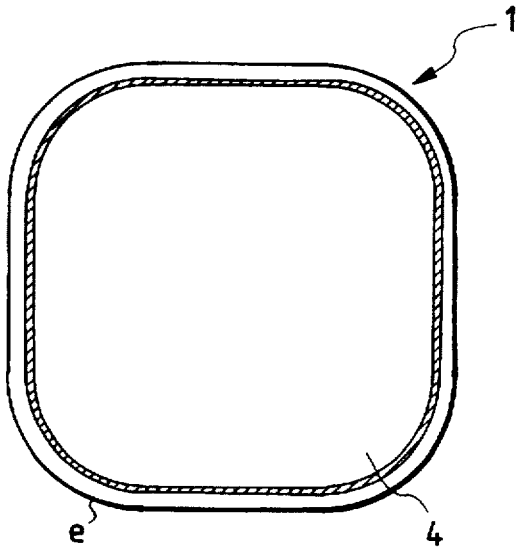
FIG. 2 is a bottom view of the fluid fire extinguishing agent shell shown in FIG. 1.

As shown in FIGS. 1 and 2, a container main body 1 is composed of red polyvinyl chloride (a trade name: Compound) having a thickness of 0.8 mm to 1.0 mm and is in a square bottle form in which a bottom face 4 is approximately a square of 80 mm×80 mm, and a rectangular cylinder (full liquid part) having a height of 160 mm is subjected to front connection with a top bung hole 3 and a continuous L-shaped bent 2. The side periphery of the rectangular cylinder is laterally covered by convexes a, b, c, d, and e in a projected state of 2 mm from the periphery, and concaves d', e', etc. corresponding to these convexes are formed in the inside of the container. The width of the convexes is set in a different size such that it is 12 mm for a, 10 mm for b, 8 mm for c, 10 mm for d, and 12 mm for e, respectively. That is, the convexes b, c, and d located in the center portion of the cylinder are formed in a smaller width than that of the convexes a and a so as to enable a person to easily grip the cylinder and throw it. Further, the edges at which the convexes intersect the periphery are rounded to improve a touch, and in order to keep the harmony with other interior decoration in a room, the cylinder being provided with an aesthetic color (red). This is a design for the purpose of expectation such that a person who has it ready as a fire protection article always becomes intimate with the article and who can effectively uses it in case of emergency. Also, a consideration is given so that when confronted with an unexpected fire, anyone can hold and merely throw it, whereby the purpose of initial fire extinction can be achieved without needs of complicated operation. A cap is formed by white polypropylene (a trade name: Aron Compound), and a packing is formed by natural-colored polyethylene (a trade name: Softlon). Such one container is poured with 800 cc of the above-described fluid fire extinguishing agent and sealed to form a rectangular cylinder shell. The temperature range for use is from −10° C. to 70° C. Since food additives are used in the fluid fire extinguishing agent of the present invention, it is non-toxic to human beings and materials and has an effect for preventing the spread of a fire to materials fully wetted by the fluid. Unless a strong physical shock is given to the container, the efficiency can be maintained for 6 years.

[C] Fire Extinction Test

With respect to the performance of the fluid fire extinguishing agent shell according to the present invention, the tests were carried out by using the No. 2 model stipulated in Ordinance No. 27, Article 3, Item 2 of the Ministry of Home Affairs of 1964.

Type of fire model: No. 2 model
Water contents of wood used in the model: 14.0%
The nearest distance to the model: 1 m
Precombustion time: 3 minutes The results of the fire extinction test are given in Table 1.

TABLE 1

| Test | Number of Throwing | Throwing Time | Throwing Person | Result |
|---|---|---|---|---|
| 1 | 1 | 14 sec. | Male (45 years old) | Extinguished |
| 2 | 1 | 15 sec. | Male (54 years old) | Extinguished |
| 3 | 2 | 20 sec. | Female (56 years old) | Extinguished |
| 4 | 2 | 19 sec. | Male (88 years old) | Extinguished |
| 5 | 1 | 16 sec. | Male (88 years old) | Extinguished |

REFERENTIAL EXAMPLE 1

Fluid fire extinguishing agent shells were produced in the same procedures as in Example 1, except for dissolving a mixture of 180 kg of $NH_4Cl$, 85 kg of $Na_2CO_3$, 30 kg of $(NH_4)_2HPO_4$, and 20 kg of $NaHCO_3$ in water to obtain a solution having a specific gravity of 1.12 and a pH of 10 to 11 and using this solution as a fluid fire extinguishing agent, in accordance with the invention as disclosed in Japanese patent Application Laid-open No. 58-127668.

The thus produced fluid fire extinguishing agent shells were subjected to the fire extinction test in the same manner as in Example 1, while repeating the throwing until the model had been extinguished. The results obtained are given in Table 2.

TABLE 2

| Test | Number of Throwing | Throwing Time | Throwing Person | Result |
|---|---|---|---|---|
| 1 | 4 | 21 sec. | Male (75 years old) | Extinguished |
| 2 | 4 | 22 sec. | Female (55 years old) | Extinguished |
| 3 | 4 | 19 sec. | Male (72 years old) | Extinguished |

It can be understood from the results of Example 1 and Referential Example 1 that the fluid fire extinguishing agent shell according to the present invention has made it possible to effect the fire extinction achieved by the corresponding prior model within a shorter period of time by a smaller number of throwing as compared with the previous ones.

EXAMPLE 2

A fire extinguishing agent shell was produced in the same manner as in Example 1, except for using 33.4 kg of $(NH_4)_2HPO_4$ and 6.6 kg of $Na_2WO_4.2H_2O$.

EXAMPLE 3

A fire extinguishing agent shell was produced in the same manner as in Example 1, except for using 20.1 kg of $(NH_4)_2HPO_4$ and 19.9 kg of $Na_2WO_4.2H_2O$.

The fluid fire extinguishing agent shell according to the present invention has the following characteristics.

(1) Since it has a size and shape such that it can be easily thrown, the fire extinction can be effected only by throwing it into the origin of a fire by people of any age and sexes.

(2) The burning materials are fire-extinguishable instantly by a chemical reaction (instant fire extinguishing action).

(3) The materials which have been once fire extinguished are never reignited (reignition protection action).

(4) Since the burnt materials can be rapidly cooled without oyxgen, after the fire extinction, even if they are touched, they do not feel hot, and burns can be prevented (rapid cooling action).

(5) A harmful smoke is vaporized (vaporization action).

(6) Since the aqueous solution itself is of no harm to humans or animals, even children can take part in the fire extinguishing activity.

(7) It is of a low price so that each family can keep it.

While the invention has been described in detail and with reference to specific embodiments thereof, it will be apparent to one skilled in the art that various changes and modifications can be made therein without departing from the spirit and scope thereof.

What is claimed is:

1. A fluid fire extinguishing agent shell for throwing into a fire, comprising a fluid fire extinguishing agent sealed in a thin-walled resin container having such a size that one can throw such container, which is breakable by shock on impact, said fluid fire extinguishing agent consisting essentially of the following dry components dissolved in water in the amounts:

| Dry Components | Amount by Weight Percent of Dry Components |
|---|---|
| Ammonium Chloride | at least about 47 |
| Sodium Bicarbonate | About 4 to about 8 |
| Potassium Carbonate | About 25 to about 35 |
| Ammonium secondary Phosphate | About 8 to about 14 |
| Sodium Tungstate | about 2 to about 6 |

wherein said dry components are completely dissolved in water in an amount such that said fluid fire extinguishing agent has a specific gravity of from about 1.25 to about 1.29.

2. The fluid fire extinguishing agent shell as defined in claim 1 wherein said fire extinguishing agent has a pH of 7.5 to 10.0.

3. The fluid fire extinguishing agent shell as defined in claim 1 wherein said ammonium chloride is present in an amount of about 47% by weight of dry components.

4. The fluid fire extinguishing agent shell as defined in claim 3 wherein said fire extinguishing agent has a pH of 7.5 to 10.0.

5. The fluid fire extinguishing agent shell as defined in claim 1 wherein said ammonium chloride is present in an amount of 49.2% by weight of dry components.

6. The fluid fire extinguishing agent shell as defined in claim 5 wherein said fire extinguishing agent has a pH of 7.5 to 10.0.

* * * * *